US010731260B2

(12) United States Patent
Seymour et al.

(10) Patent No.: US 10,731,260 B2
(45) Date of Patent: Aug. 4, 2020

(54) ROTOR WITH ZIRCONIA-TOUGHENED ALUMINA COATING

(71) Applicant: United Technologies Corporation, Farmington, CT (US)

(72) Inventors: Kevin Seymour, Marlborough, CT (US); Christopher W. Strock, Kennebunk, ME (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 267 days.

(21) Appl. No.: 15/619,599

(22) Filed: Jun. 12, 2017

(65) Prior Publication Data

US 2018/0355489 A1 Dec. 13, 2018

(51) Int. Cl.

| | |
|---|---|
| ***C23C 28/00*** | (2006.01) |
| ***F01D 25/00*** | (2006.01) |
| ***F01D 5/28*** | (2006.01) |
| ***F01D 5/34*** | (2006.01) |
| ***F01D 11/00*** | (2006.01) |
| ***C23C 30/00*** | (2006.01) |

(52) U.S. Cl.

CPC ..... *C23C 28/3455* (2013.01); *C23C 28/321* (2013.01); *C23C 28/3215* (2013.01); *C23C 30/00* (2013.01); *F01D 5/288* (2013.01); *F01D 5/34* (2013.01); *F01D 11/001* (2013.01); *F01D 25/005* (2013.01); *F05D 2230/53* (2013.01); *F05D 2230/90* (2013.01); *F05D 2300/2112* (2013.01); *F05D 2300/2118* (2013.01); *F05D 2300/605* (2013.01); *F05D 2300/609* (2013.01); *F05D 2300/611* (2013.01)

(58) Field of Classification Search

None

See application file for complete search history.

(56) References Cited

U.S. PATENT DOCUMENTS

| | | | |
|---|---|---|---|
| 4,218,253 A | 8/1980 | Dworak et al. | |
| 5,032,555 A | 7/1991 | Yamanis et al. | |

(Continued)

FOREIGN PATENT DOCUMENTS

| | | | |
|---|---|---|---|
| EP | 0919699 A2 * | 6/1999 | ..... C23C 28/321 |
| EP | 1600518 | 11/2005 | |

(Continued)

OTHER PUBLICATIONS

Extended European Search Report for EP Application No. 18177263.3, dated Jul. 26, 2018.

(Continued)

*Primary Examiner* — David Sample

*Assistant Examiner* — Elizabeth Collister

(74) *Attorney, Agent, or Firm* — Carlson, Gaskey & Olds, PC.

(57) ABSTRACT

A gas turbine engine includes a rotor that has a rim, blades extending radially outwards from the rim, a hub extending radially inwards from the rim, an arm extending axially from the rim, the arm having a radially outer surface, and a coating disposed on the radially outer surface. The coating is zirconia-toughened alumina in which the alumina is a matrix with grains of the zirconia dispersed there through. The grains of zirconia are predominantly a tetragonal crystal structure.

15 Claims, 3 Drawing Sheets

(56) References Cited

U.S. PATENT DOCUMENTS

| | | | | |
|---|---|---|---|---|
| 5,059,095 | A | 10/1991 | Kushner et al. | |
| 7,179,526 | B2 | 2/2007 | Rosenflanz et al. | |
| 7,255,898 | B2 | 8/2007 | O'Donnell et al. | |
| 8,679,246 | B2 | 3/2014 | Jordan et al. | |
| 2003/0138659 | A1* | 7/2003 | Shanker | C23C 4/02 428/632 |
| 2012/0017805 | A1* | 1/2012 | Jordan | C09D 1/00 106/286.4 |
| 2012/0194396 | A1* | 8/2012 | Mitchell | F01D 17/02 343/720 |
| 2016/0201466 | A1* | 7/2016 | Fink | F01D 11/001 416/185 |

FOREIGN PATENT DOCUMENTS

| | | |
|---|---|---|
| EP | 1905952 | 4/2008 |
| EP | 2168936 | 3/2010 |
| EP | 3012411 | 4/2016 |

OTHER PUBLICATIONS

Dejang, N., Limpichaipanit, A., Watcharapasorn, A., Wirojanupatump, S., Niranatlumpong, P., Jiansirisomboon, S. (2011). Fabrication and properties of plasma-sprayed Al2O3/ZrO2 composite coatings. Journal of Thermal Spray Technology. vol. 20(6). Dec. 2011. pp. 1259-1268.

Berghaus, J.O., Legoux, J-G., Mareau, C., Tarasi, F., and Chraska, T. (2008). Mechanical and thermal transport poroperties of suspension thermal-sprayed alumina-zirconia composite coatings. Journal of Thermal Spray Technology. vol. 17(1). Mar. 2008. pp. 91-104.

Chen, D., Jordan, E.H., and Gell, M. (2009). Microstructure of suspension plasma spray and air plasma spray Al2O3—ZrO2 composite coatings. Journal of Thermal Spray Technology. vol. 18(3). Sep. 2009. pp. 421-426.

Garvie, R.C., Hannink, R.H., Pascoe, R.T. (1975). Abstract. Ceramic steel? Nature vol. 258. Retrieved Jun. 9, 2017 from: https://www.nature.com/nature/journal/v258/n5537/abs/258703a0.html.

* cited by examiner

ROTOR WITH ZIRCONIA-TOUGHENED ALUMINA COATING

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

SUMMARY

A gas turbine engine according to an example of the present disclosure includes a rotor that has a rim, blades extending radially outwards from the rim, a hub extending radially inwards from the rim, an arm extending axially from the rim, and a coating disposed on a radially outer surface of the arm. The coating is formed of zirconia-toughened alumina, in which the alumina is a matrix, with grains of the zirconia dispersed through the matrix. The grains of zirconia are predominantly a tetragonal crystal structure.

In a further embodiment, the zirconia-toughened alumina has a composition, by weight percent, of 5%-20% zirconia and 80%-95% alumina.

In a further embodiment of any of the foregoing, the zirconia-toughened alumina consists of, by weight percent, 5%-20% zirconia and 80%-95% alumina.

In a further embodiment of any of the foregoing, the grains have a grain size of 10-60 nanometers.

In a further embodiment of any of the foregoing, the coating has a thickness of at least 0.2 millimeters.

In a further embodiment of any of the foregoing, at least 80% of the grains, by weight %, are the tetragonal crystal structure.

A further embodiment of any of the foregoing includes a bond coating between the coating and the radially outer surface of the arm.

In a further embodiment of any of the foregoing, the bond coating is a nickel-aluminum coating.

In a further embodiment of any of the foregoing, the nickel-aluminum coating has a composition, by weight percent, of up to 20% aluminum.

In a further embodiment of any of the foregoing, the bond coating has a composition that includes at least one of nickel, cobalt, or iron, and chromium, aluminum, and/or yttrium.

In a further embodiment of any of the foregoing, the rotor is an integrally bladed rotor in which the rim, the hub, and the arm are a single monolithic body.

In a further embodiment of any of the foregoing, the grains have a grain size of 10-60 nanometers and the coating has a thickness of at least 0.2 millimeters.

In a further embodiment of any of the foregoing, at least 80% of the grains have the tetragonal crystal structure.

In a further embodiment of any of the foregoing, the zirconia-toughened alumina has a composition, by weight percent, of 5%-20% zirconia and 80%-95% alumina, the grains have a grain size of 10-60 nanometers, and at least 80% of the grains have the tetragonal grain structure.

In a further embodiment of any of the foregoing, the rotor is an integrally bladed rotor in which the rim, the hub, and the arm are a single monolithic body.

A further embodiment of any of the foregoing includes a bond coating between the coating and the radially outer surface of the arm, wherein the bond coating is a nickel-aluminum coating that has a composition, by weight percent, of up to 20% aluminum.

A further embodiment of any of the foregoing includes a bond coating between the coating and the radially outer surface of the arm, wherein the bond coating has a composition that includes at least one of nickel, cobalt, or iron, and chromium, aluminum, and yttrium.

In a further embodiment of any of the foregoing, at least 90% of the grains have the tetragonal grain structure.

A gas turbine engine according to an example of the present disclosure includes a rotor that has a rim, blades extending radially outwards from the rim, a hub extending radially inwards from the rim, and a coating disposed on a portion of the rotor. The coating is formed of zirconia-toughened alumina in which the alumina is a matrix, with grains of the zirconia dispersed through the matrix. The grains of zirconia are predominantly a tetragonal crystal structure.

In a further embodiment of any of the foregoing, the portion of the rotor that has the coating is selected from the group consisting of an arm extending axially from the rim, a knife edge seal on the rotor, or a spacer of the rotor.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
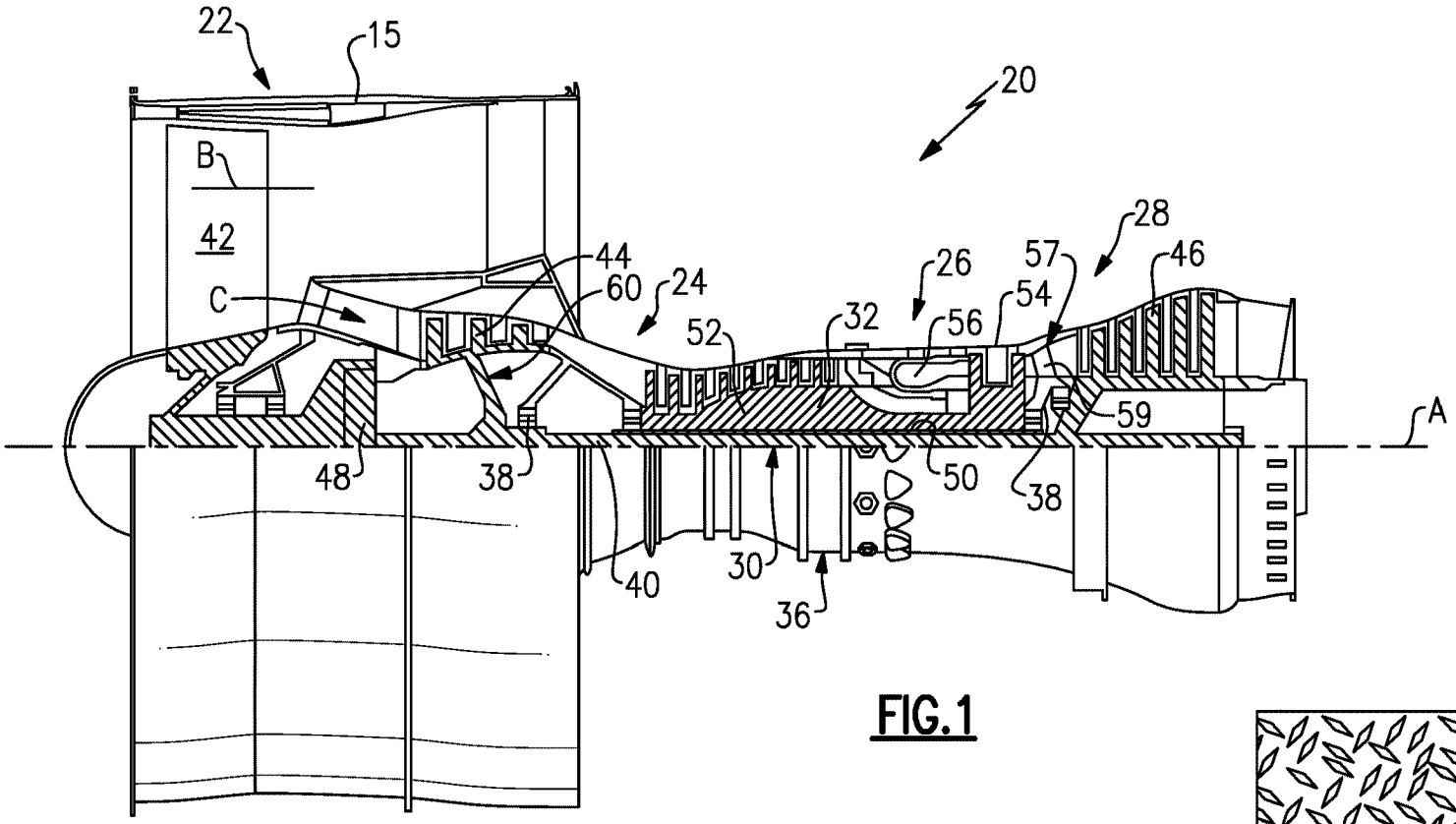
FIG. 1 illustrates an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features.

The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
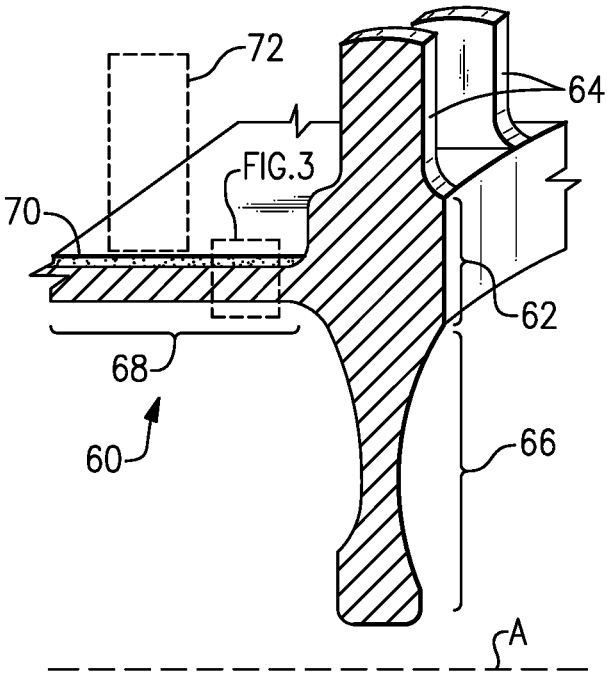
FIG. 2 illustrates a sectioned view of a rotor of the gas turbine engine.

The high pressure compressor 52 in the example engine 20 includes a rotor 60, which is also shown in a sectioned view in FIG. 2. Although examples herein may be described with regard to rotors, it is to be understood that other gas turbine engine components may also benefit, such as but not limited to, bearing compartment seals. The rotor 60 includes a rim 62, blades 64 that extend radially outwards from the rim 62, a hub 66 that extends radially inwards from the rim 62, and an arm 68 that extends axially from the rim 62. Here, the arm 68 extends in a forward direction; however, it is to be understood that the arm could alternatively extend in an aft direction from the other side of the rim 62. In this example, the rim 62, the blades 64, and the hub 66 are a single monolithic body. That is, the rotor 60 is a single, continuous piece that does not have joints or seams. A coating 70 is disposed on the arm 68. Static vanes, one shown at 72, are located adjacent the arm 68 and coating 70. Upon rotation of the rotor 60, the static vanes 72 may, at times, contact the coating 70. In this regard, the coating 70 is, or is a part of, an inner air seal between the vanes 72 and rotor 60.

Figure 3:
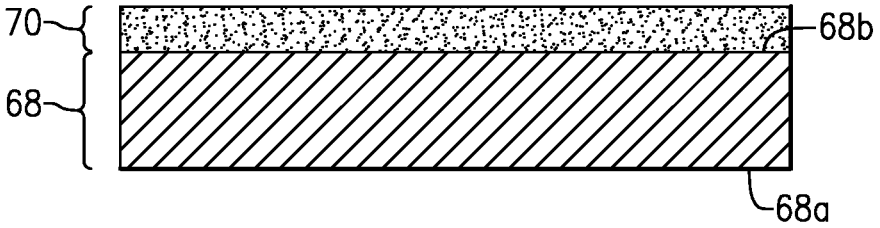
FIG. 3 illustrates a sectioned view of an arm and coating of the rotor.

A representative sectioned view of the arm 68 and coating 70 is shown in FIG. 3. The arm 68 includes radially inner and outer surfaces **68*a*/68*b*. The coating 70 is disposed directly on the radially outer surface 68*b*. For example, this location in the engine 20 is potentially subject to high thermal strains. The coating 70** is zirconia-toughened alumina ("ZTA") in order to manage the high levels of strain.

Figure 4:
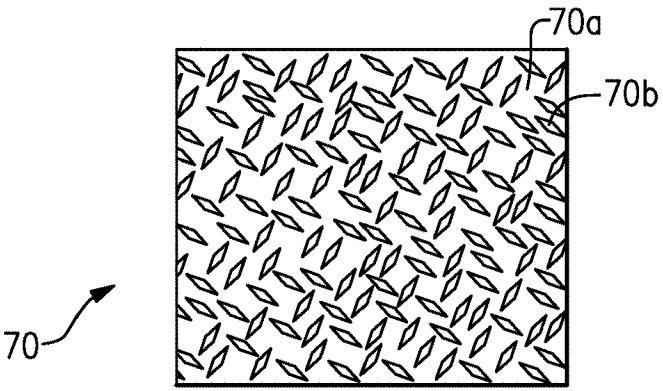
FIG. 4 illustrates a representative view of zirconia-toughened alumina of the coating.

The ZTA facilitates arrest crack propagation in the coating 70 due to high strain. This strain can be the result of thermal expansion mismatch, part design, and engine operation, for example. FIG. 4 illustrates a representative sectioned view of the coating 70. The alumina of the ZTA is a matrix **70*a*, with grains 70*b* of the zirconia dispersed through the matrix 70*a*. The grains 70*b* of zirconia are predominantly a tetragonal crystal structure and have a grain size of 10-60 nanometers. In one further example, a majority of the grains 70*b*** are of the tetragonal crystal structure. At 20° C. zirconia is stable in a monoclinic crystal structure. During processing at high temperatures zirconia transforms to the tetragonal crystal structure. Upon cooling, zirconia converts back to monoclinic. In transforming from tetragonal to monoclinic the zirconia increases in volume.

However, when constrained, as in the matrix **70*a*, the conversion from tetragonal to monoclinic is inhibited. In the coating 70, by weight percentage at least 80% of the zirconia by weight is in the tetragonal crystal structure, constrained by the matrix 70***a*. X-ray diffraction can be used to calculate the weight percentage of the tetragonal and other phases in the coating 70. A propagating crack in the coating 70 that encounters a grain 70*b* opens free volume adjacent the grain 70*b*. The free volume allows the grain 70*b* to transform from tetragonal to monoclinic. The accompanying volume increase blunts the crack tip and thereby helps to arrest the crack. The arrest of cracks in this manner in the coating 70 toughens the coating 70. The coating 70 can thus be used on the arm 68, a location where the strain that the coating 70 is subjected to exceeds the strain for crack initiation.

In one example, the coating 70 has a composition, by weight percent, of 5%-20% zirconia and 80%-95% alumina. In a further example, the coating 70 has only zirconia and alumina in the weight ranges. With the toughening effect of the zirconia grains 70*b*, the coating 70 can be made thicker than a comparable coating that is formed only of alumina, which would crack and spall. For example, the coating 70 has a thickness of at least 0.2 millimeters. For a thicker and tougher coating 70, a higher amount of zirconia grains 70*b* can be used, such as approximately 90% by weight.

Figure 5:
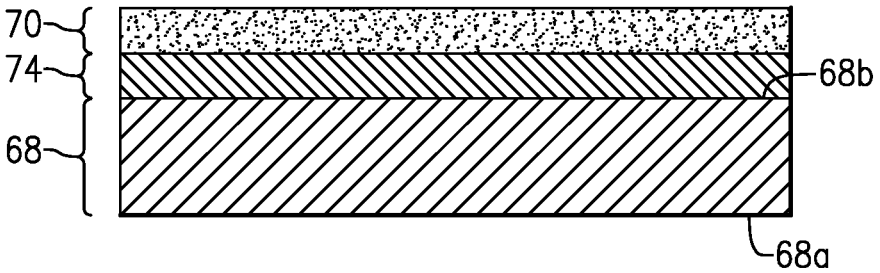
FIG. 5 illustrates another example of the arm and coating of the rotor, with a bond coating.

FIG. 5 illustrates another example of the coating 70. In this example, there is a bond coating 74 between the coating 70 and the radially outer surface 68*b* of the arm 68. For instance, the bond coating 74 contacts the coating 70 and the radially outer surface 68*b* of the arm 68. In one example, the bond coating 74 is a nickel-aluminum coating. For instance, the nickel-aluminum coating has a composition, by weight percent, of up to 20% aluminum. In another example, the bond coating 74 has a composition that includes at least one of nickel, cobalt, or iron, and chromium, aluminum, and yttrium (MCrAlY) and optionally one or more of hafnium and silicon.

The coating 70 may be formed via plasma spray or suspension plasma spray, for example. In the spray process, zirconia powder can either be injected into the plasma plume separate from alumina powder or the zirconia and alumina powders may be mixed and co-injected into the plasma plume. The co-injection provides more uniform dispersion of the zirconia in the alumina.

Figure 6:
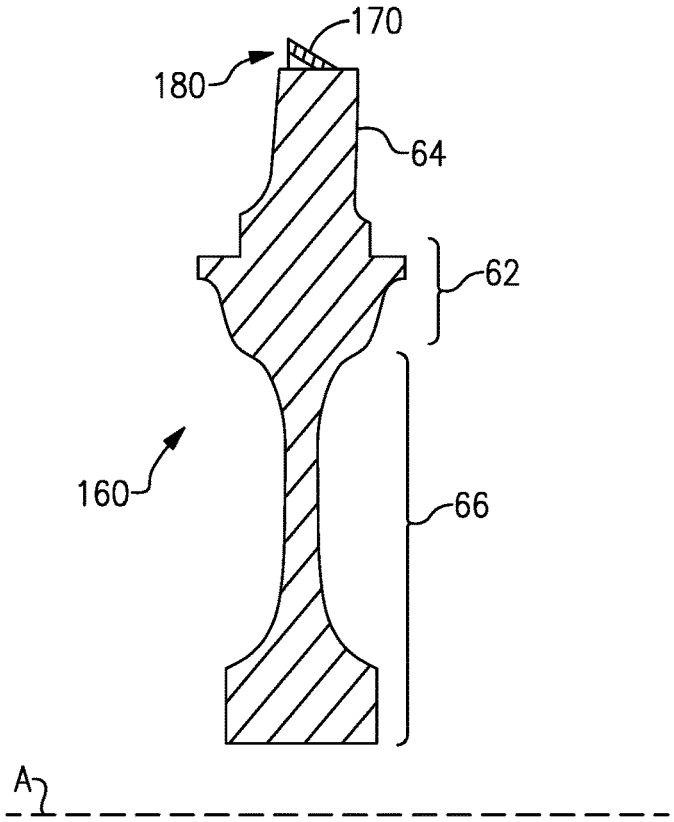
FIG. 6 illustrates another example rotor, which has a knife edge seal.

FIG. 6 illustrates another example rotor 160. In this disclosure, like reference numerals designate like elements where appropriate and reference numerals with the addition of one-hundred or multiples thereof designate modified elements that are understood to incorporate the same features and benefits of the corresponding elements. In this example, the rotor 160 does not include an arm or arms 68 as the rotor 60 does. Here, the rotor 160 includes a knife edge seal 180 that includes a coating 170. The coating 170 is zirconia-toughened alumina ("ZTA"), as discussed above for coating 70. Alternatively, in one further example that is somewhat of a hybrid between rotor 60 and rotor 160, the knife edge seal 180 could be located in the place of the coating 70 on the arm 68.

Figure 7:
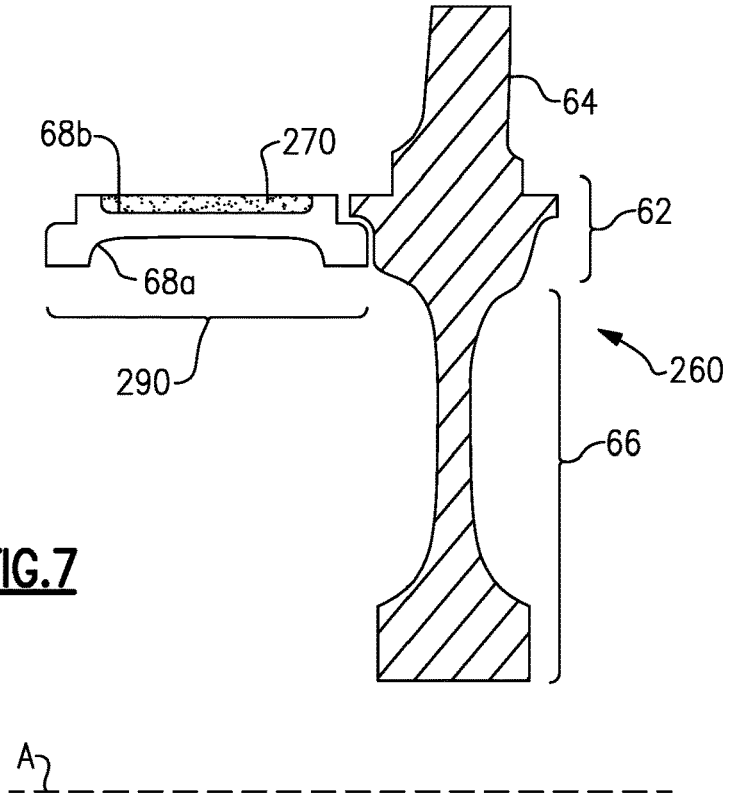
FIG. 7 illustrates another example rotor with a rotor spacer.

FIG. 7 illustrates another example rotor 260 that has a rotor spacer 290. The rotor spacer 290 is similar to the arm 68 but is a separate piece rather than an integration with the rim 62. The rotor spacer 290 serves to space the remaining portion of the rotor 260 from the next, neighboring rotor. The rotor spacer 290 in this example extends in a forward direction from the rim 62; however, it is to be understood that in alternate examples the rotor spacer 290 may extend in the aft direction from the other side of the rim 62. Similar to the arm 68, the rotor spacer 290 includes a coating 270. The coating 270 is zirconia-toughened alumina ("ZTA"), as discussed above for coating 70.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A gas turbine engine comprising:

a rotor including a rim, blades extending radially outwards from the rim, a hub extending radially inwards from the rim, an arm extending axially from the rim, and a knife edge seal projecting from the arm, the knife edge seal having a radially outer surface, and a coating disposed on the radially outer surface, the coating being formed of zirconia-toughened alumina in which the alumina is a matrix, with grains of the zirconia dispersed through the matrix, the grains of zirconia being predominantly a tetragonal crystal structure, the zirconia-toughened alumina having a composition, by weight percent, of approximately 90% zirconia and a remainder of alumina.

2. The gas turbine engine as recited in claim 1, wherein the grains have a grain size of 10-60 nanometers.

3. The gas turbine engine as recited in claim 1, wherein the coating has a thickness of at least 0.2 millimeters.

4. The gas turbine engine as recited in claim 1, wherein by weight % at least 80% of the grains are the tetragonal crystal structure.

5. The gas turbine engine as recited in claim 1, further comprising a bond coating between the coating and the radially outer surface of the arm.

6. The gas turbine engine as recited in claim 5, wherein the bond coating is a nickel-aluminum coating.

7. The gas turbine engine as recited in claim 6, wherein the nickel-aluminum coating has a composition, by weight percent, of up to 20% aluminum.

8. The gas turbine engine as recited in claim 5, wherein the bond coating has a composition that includes at least one of nickel, cobalt, or iron, and chromium, aluminum, and/or yttrium.

9. The gas turbine engine as recited in claim 1, wherein the rotor is an integrally bladed rotor in which the rim, the hub, and the arm are a single monolithic body.

10. The gas turbine engine as recited in claim 1, wherein the grains have a grain size of 10-60 nanometers and the coating has a thickness of at least 0.2 millimeters.

11. The gas turbine engine as recited in claim 10, wherein at least 80% of the grains have the tetragonal crystal structure.

12. The gas turbine engine as recited in claim 1, wherein the rotor is an integrally bladed rotor in which the rim, the hub, and the arm are a single monolithic body.

13. The gas turbine engine as recited in claim 12, further comprising a bond coating between the coating and the radially outer surface of the arm, wherein the bond coating is a nickel-aluminum coating that has a composition, by weight percent, of up to 20% aluminum.

14. The gas turbine engine as recited in claim 12, further comprising a bond coating between the coating and the radially outer surface of the arm, wherein the bond coating has a composition that includes at least one of nickel, cobalt, or iron, and chromium, aluminum, and/or yttrium.

15. The gas turbine engine as recited in claim 12, wherein at least 90% of the grains have the tetragonal grain structure.

* * * * *